US011279579B2

(12) United States Patent
Yamamoto

(10) Patent No.: US 11,279,579 B2
(45) Date of Patent: Mar. 22, 2022

(54) SHEET FEED DEVICE AND IMAGE FORMATION DEVICE EQUIPPED WITH SAME

(71) Applicant: KYOCERA Document Solutions Inc., Osaka (JP)

(72) Inventor: Kiyonori Yamamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/970,614

(22) PCT Filed: Oct. 2, 2018

(86) PCT No.: PCT/JP2018/036827
§ 371 (c)(1),
(2) Date: Aug. 17, 2020

(87) PCT Pub. No.: WO2019/159423
PCT Pub. Date: Aug. 22, 2019

(65) Prior Publication Data

US 2021/0087006 A1 Mar. 25, 2021

(30) Foreign Application Priority Data

Feb. 19, 2018 (JP) ..... JP2018-026769

(51) Int. Cl.
*B65H 3/52* (2006.01)
*G03G 15/00* (2006.01)

(52) U.S. Cl.
CPC ..... *B65H 3/52* (2013.01); *G03G 15/6511* (2013.01); *B65H 2601/273* (2013.01); *G03G 2215/004* (2013.01)

(58) Field of Classification Search
CPC .. B65H 3/52; B65H 2601/273; B65H 3/0607; B65H 3/0684; G03G 15/6511; G03G 2215/004
See application file for complete search history.

(56) References Cited

U.S. PATENT DOCUMENTS 8,695,965 B2 * 4/2014 Shin ..... B65H 3/5215 271/121
9,022,382 B2 * 5/2015 Takai ..... B65H 1/266 271/125
9,079,731 B2 * 7/2015 Takahata ..... B65H 3/5223

FOREIGN PATENT DOCUMENTS

JP 61-166447 * 7/1986
JP H 11-091971 A 4/1999

* cited by examiner

*Primary Examiner* — Thomas A Morrison
(74) *Attorney, Agent, or Firm* — Stein IP, LLC

(57) ABSTRACT

Provided are: a sheet feed device that is capable of suppressing the occurrence of a sheet feeding fault by changing the pressing contact force of a retard roller against a feed roller; and an image formation device equipped with the same. This sheet feed unit (50) is provided with: a pickup roller (29); a feed roller (31); a retard roller (32); a holding member (40) that holds the retard roller (32); a first biasing member (42) that biases the holding member (40); and a pressing contact force changing mechanism (60) that changes the pressing contact force of the retard roller (32) against the feed roller (31). The pressing contact force changing mechanism (60) has: a rotary shaft (61) disposed parallel to the axial direction of the retard roller (32); a cam member (70) that rotates with the rotary shaft (61); and a movable member (80) that contacts the cam member (70), moves in the axial direction in conjunction with the rotation of the cam member (70), and changes the biasing force generated by the first biasing member (42).

8 Claims, 8 Drawing Sheets

SHEET FEED DEVICE AND IMAGE FORMATION DEVICE EQUIPPED WITH SAME

CROSS-REFERENCE TO RELATED APPLICATIONS

This application is a national stage of International Application No. PCT/JP2018/036827, filed Oct. 2, 2018, which claims the benefit of Japanese Application No. 2018-026769, filed Feb. 19, 2018, in the Japanese Patent Office, the disclosures of which are incorporated herein by reference.

TECHNICAL FIELD

The present invention relates to a sheet feeding device and an image forming apparatus that includes such a sheet feeding device, and particularly relates to a sheet feeding device that includes a pickup roller which feeds out a sheet from a sheet storage cassette, a feed roller which conveys the sheet fed out from the pickup roller and a retard roller which forms a feed roller pair together with the feed roller and an image forming apparatus that includes such a sheet feeding device.

BACKGROUND ART

Conventionally, an image forming apparatus is known that includes a sheet feeding device including: a pickup roller which feeds out a paper sheet from a paper feed cassette (sheet storage cassette) storing paper sheets (sheets): a feed roller which conveys the paper sheet fed out from the pickup roller; and a retard roller which forms a feed roller pair together with the feed roller.

The retard roller is pressed to the feed roller with a predetermined pressing force caused by a biasing member such as a spring. When the pickup roller simultaneously feeds a plurality of paper sheets, the feed roller and the retard roller separate the paper sheets so as to feed out only the uppermost paper sheet.

An image forming apparatus which includes the pickup roller, the feed roller and the retard roller which is pressed to the feed roller is disclosed in, for example, patent document 1.

RELATED ART DOCUMENT

Patent Document

Patent document 1: Japanese Unexamined Patent Application Publication No. H11-91971

SUMMARY OF INVENTION

Problems to be Solved by the Invention

However, in the conventional image forming apparatus, when the pressing force of the retard roller to the feed roller is large, simultaneous feeding occurs on thin paper whereas when the pressing force of the retard roller to the feed roller is small, no paper feed (non-feeding) occurs on thick paper. In other words, in the conventional image forming apparatus, it is difficult to reduce the occurrence of a convey failure on a large number of types of sheets.

The present invention is made in order to solve the problem as described above, and an object of the present invention is to provide a sheet feeding device which changes the pressing force of a retard roller to a feed roller so as to be able to reduce the occurrence of a sheet convey failure and an image forming apparatus which includes such a sheet feeding device.

Means for Solving the Problem

A sheet feeding device according to a first aspect of the present invention includes: a frame; a feed roller which conveys a sheet fed out from a pickup roller; a retard roller which forms a feed roller pair together with the feed roller and conveys the sheets while separating the sheets; a holding member which is supported on the frame and holds the retard roller such that the retard roller is capable of being brought into contact with and being separated from the feed roller; a first biasing member which biases the holding member so as to press the retard roller to the feed roller; and a pressing force change mechanism which changes the pressing force of the retard roller to the feed roller. The pressing force change mechanism includes: a rotation shaft which is arranged parallel to the axial direction of the retard roller; a cam member which is attached to the rotation shaft and which is rotated together with the rotation shaft; and a movement member which is brought into contact with the cam member and moved in the axial direction in conjunction with the rotation of the cam member so as to change the biasing force of the first biasing member.

Advantages of the Invention

In a sheet feeding device according to a first aspect of the present invention, a first biasing member which biases a holding member so as to press a retard roller to a feed roller and a pressing force change mechanism which changes the pressing force of the retard roller to the feed roller are provided, and the pressing force change mechanism includes: a rotation shaft which is arranged parallel to the axial direction of the retard roller; a cam member which is attached to the rotation shaft and which is rotated together with the rotation shaft; and a movement member which is brought into contact with the cam member and which is moved in the axial direction in synchronization with the rotation of the cam member so as to change the biasing force of the first biasing member. In this way, the rotation shaft of the pressing force change mechanism is rotated, and thus the biasing force of the first biasing member is changed, with the result that it is possible to change the pressing force of the retard roller to the feed roller. Hence, it is possible to reduce the occurrence of a sheet convey failure.

Further other objects of the present invention and specific advantages obtained by the present invention will become more apparent from the description of embodiments given below.

DESCRIPTION OF EMBODIMENTS

Embodiments of the present invention will be described below with reference to drawings.

First Embodiment

Figure 1:
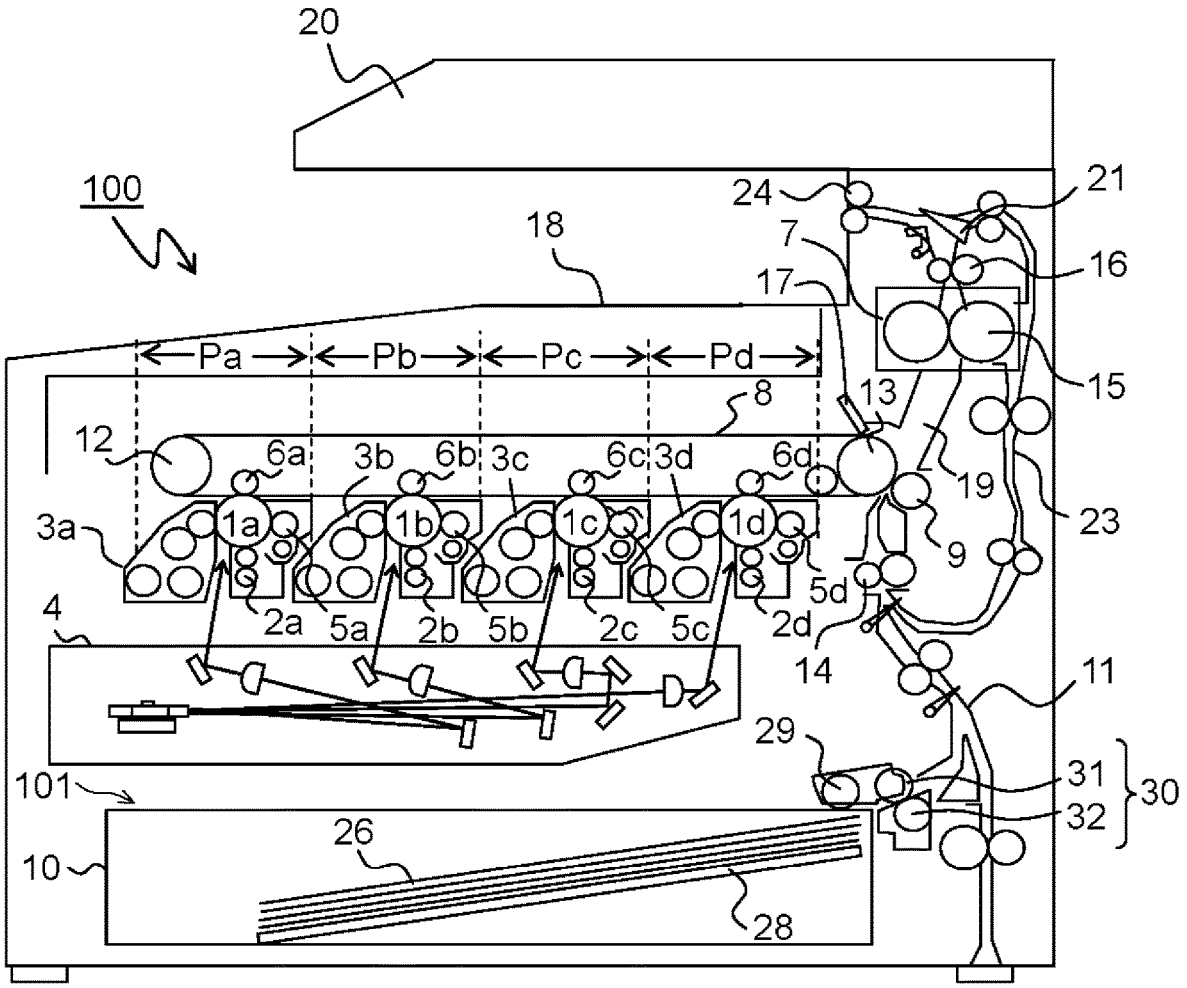
FIG. 1 is a cross-sectional view showing the overall structure of an image forming apparatus which includes a paper feed unit (sheet feeding device) according to a first embodiment of the present invention.

As shown in FIG. 1, an image forming apparatus 100 which includes a paper feed unit (sheet feeding device) 50 according to a first embodiment of the present invention is a tandem type color copying machine, and within the main body of the image forming apparatus 100, four image formation portions Pa, Pb, Pc and Pd are sequentially arranged from the left side of FIG. 1. The image formation portions Pa to Pd are provided so as to correspond to images of four different colors (yellow, magenta, cyan and black), and respectively form images of yellow, magenta, cyan and black sequentially in the steps of charging, exposure, development and transfer.

In the image formation portions Pa to Pd, photosensitive drums 1*a*, 1*b*, 1*c* and 1*c* which carry the visible images (toner images) of the individual colors are arranged, and furthermore, an intermediate transfer belt 8 which is rotated in the counterclockwise direction in FIG. 1 is provided adjacent to the image formation portions Pa to Pd. The toner images formed on the photosensitive drums 1*a* to 1*d* are sequentially transferred and superimposed on the intermediate transfer belt 8 which is moved while abutting on the photosensitive drums 1*a* to 1*d*, are thereafter transferred on a sheet 26 such as a paper sheet by the action of a secondary transfer roller 9, are further fixed on the sheet 26 with a fixing device 7 and are thereafter ejected from the main body of the image forming apparatus 100. While the photosensitive drums 1*a* to 1*d* are being rotated in the clockwise direction in FIG. 1, an image formation process is performed on the photosensitive drums 1*a* to 1*d*.

In a lower portion of the main body of the image forming apparatus 100, a fitting portion 101 is provided, and a paper feed cassette (sheet storage cassette) 10 in which the sheets 26 are stored is fitted to the fitting portion 101 such that the paper feed cassette 10 can be inserted into and removed from the fitting portion 101. The paper feed cassette 10 is formed so as to be fitted to and removed from the front surface of the main body of the image forming apparatus 100 (front side with respect to the plane of FIG. 1).

The sheets 26 are stacked on the sheet stacking plate 28 of the paper feed cassette 10, a pickup roller 29 is rotated in a state where the upper surface of the sheets 26 is pressed to the pickup roller 29 with a predetermined pressure and thus the feeding of the sheet 26 is started. Then, only the uppermost sheet among a plurality of sheets 26 is separated with a feed roller pair 30, and is conveyed toward a sheet convey path 11. The sheet 26 which is passed through the sheet convey path 11 reaches a registration roller pair 14, and is conveyed to a nip portion between the secondary transfer roller 9 and the drive roller 13 of the intermediate transfer belt 8 with timing of image formation.

As the intermediate transfer belt 8, a sheet formed of a dielectric resin is used, and a (seamless) belt which has no seam is mainly used. On the downstream side in the direction of movement of the intermediate transfer belt 8 when seen from the secondary transfer roller 9, a cleaning blade 17 for removing toner left on the surface of the intermediate transfer belt 8 is arranged.

An image reading portion 20 is arranged in an upper portion of the main body of the image forming apparatus 100, and reads, when copying is performed, the image of an original document so as to convert it into image data.

The image formation portions Pa to Pd will then be described. Around and below the photosensitive drums 1*a* to 1*d*, charging devices 2*a*, 2*b*, 2*c* and 2*d*, an exposure device 4, development devices 3*a*, 3*b*, 3*c* an 3*d* and cleaning devices 5*a*, 5*b*, 5*c* and 5*d* are provided.

When the image data is input from the image reading portion 20, the surfaces of the photosensitive drums 1*a* to 1*d* are first electrostatically charged uniformly with the charging devices 2*a* to 2*d*, a light beam is then applied with the exposure device 4 and thus electrostatic latent images corresponding to the image data are formed on the photosensitive drums 1*a* to 1*d*. The development devices 3*a* to 3*d* include development rollers (developer carrying members) arranged opposite the photosensitive drums 1*a* to 1*d*, and predetermined amounts of two-component developers including the toners of the colors of yellow, magenta, cyan and black are respectively charged into the development devices 3*a* to 3*d*. The toners are supplied with the development rollers onto the photosensitive drums 1*a* to 1*d* so as to form the toner images corresponding to the electrostatic latent images.

Then, the toner images on the photosensitive drums 1*a* to 1*d* are primarily transferred on the intermediate transfer belt 8. Thereafter, the toners left on the surfaces of the photosensitive drums 1*a* to 1*d* are removed with the cleaning devices 5*a* to 5*d*.

The intermediate transfer belt 8 is placed over a driven roller 12 and a drive roller 13, and when the rotation of the intermediate transfer belt 8 in the counterclockwise direction is started as the drive roller 13 is rotated, the sheet 26 is conveyed to the nip portion (secondary transfer nip portion) between the secondary transfer roller 9 and the intermediate transfer belt 8 with predetermined timing, and a full color image is secondarily transferred on the sheet 26 in the nip portion.

When the sheet 26 is conveyed to the fixing device 7 and is passed through the nip portion (fixing nip portion) of a fixing roller pair 15, the sheet 26 is heated and pressurized, and thus the toner images are fixed to the surface of the sheet 26, with the result that the predetermined full color image is formed. Thereafter, the sheet 26 is passed through a convey roller pair 16, the direction of convey thereof is switched with a convey guide member 21 which is arranged in the branch portion of a sheet convey path 19 and thus the sheet 26 is ejected through an ejection roller pair 24 to an ejection tray 18 without being processed (or after being fed to a double-sided convey path 23 so as to be subjected to double-sided copying).

On the downstream side of the convey roller pair 16, the sheet convey path 19 communicates with the ejection tray 18 or the double-sided convey path 23.

A configuration around the pickup roller 29 will then be described.

The pickup roller 29 feeds out the sheet 26 from the paper feed cassette 10. The feed roller pair 30 includes: a feed roller 31 which conveys the sheet 26 fed out from the pickup roller 29; and a retard roller 32 which is arranged opposite the feed roller 31 and which is pressed to the feed roller 31 so as to form the nip portion for conveying the sheet 26. Between the feed roller 31 and the pickup roller 29, a drive force transmission gear (unillustrated) is arranged which transmits the rotation of the feed roller 31 to the pickup roller 29.

Figure 2:
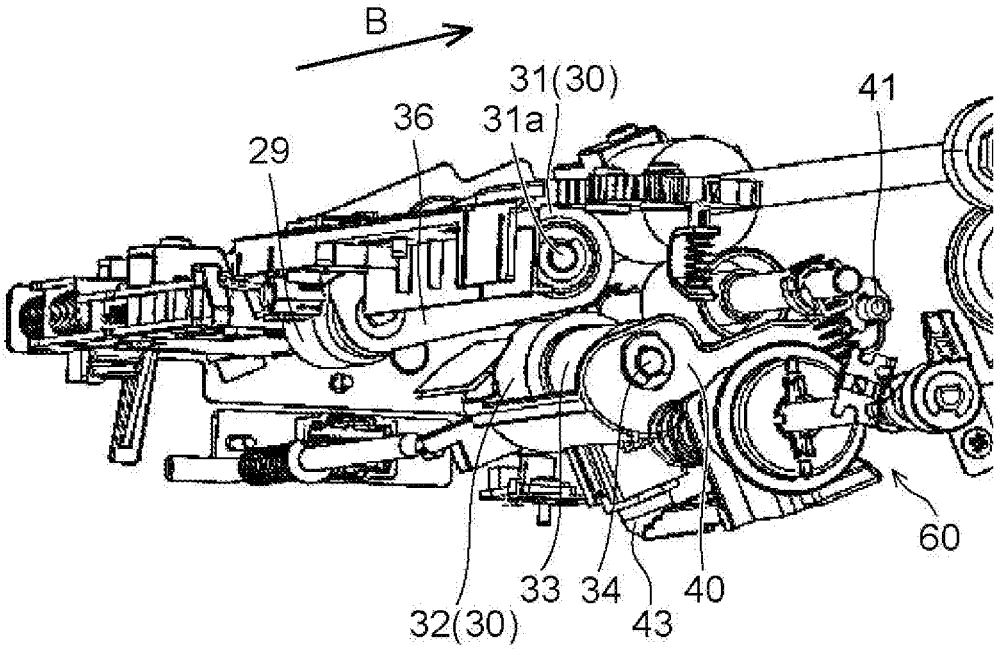
FIG. 2 is a perspective view showing a structure around the paper feed unit according to the first embodiment of the present invention.
Figure 3:
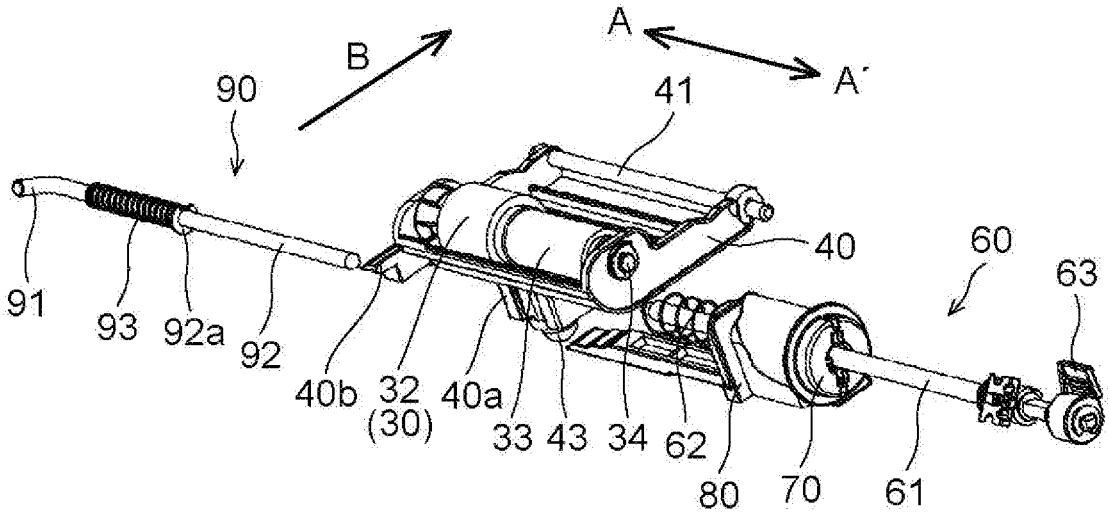
FIG. 3 is a perspective view showing a structure around a retard roller and a pressing force change mechanism in the paper feed unit according to the first embodiment of the present invention.

The feed roller 31 and the retard roller 32 convey the sheets 26 fed out from the pickup roller 29 one by one. Specifically, as shown in FIG. 2, the feed roller 31 is attached to a rotation shaft 31*a* coupled to an unillustrated drive motor (drive source), and is rotated with a drive force from the drive motor. The retard roller 32 is pressed to the feed roller 31 and is driven to rotate. As shown in FIGS. 2 and 3, the retard roller 32 is pivotally supported with a rotation shaft 34 through a torque limiter 33, and the retard roller 32 is stopped until a predetermined torque is applied and is driven to rotate with respect to the feed roller 31 when a torque exceeding the predetermined torque is applied. In this way, the pickup roller 29 is rotated in a state where the pickup roller 29 is pressed to the sheet 26, and thus the feeding of the sheet 26 is started, and when the pickup roller 29 simultaneously feeds a plurality of sheets 26, the sheets 26 are separated with the feed roller 31 and the retard roller 32 in a state where the retard roller 32 is stopped by the action of the torque limiter 33, with the result that only the uppermost sheet is fed out toward the sheet convey path 11.

The pickup roller 29 and the feed roller 31 are pivotally supported with a roller holding member 36 so as to be able to rotate. The retard roller 32 is pivotally supported with a holding member 40 so as to be able to rotate. A swinging shaft 41 is provided at an end portion of the holding member 40 on the downstream side in the direction of convey of the sheet (direction of an arrow B), and a portion of the holding member 40 on the upstream side in the direction of convey of the sheet can be swung in up/down directions with the swinging shaft 41 serving as a supporting point. In other words, the holding member 40 holds the retard roller 32 such that the retard roller 32 is separable with respect to the feed roller 31.

Figure 4:
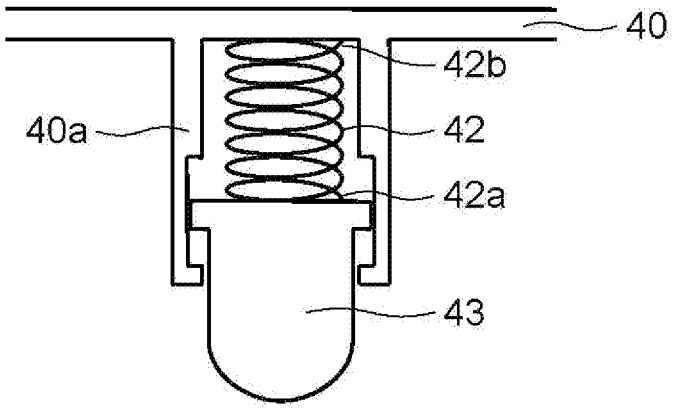
FIG. 4 is a cross-sectional view showing a structure around a protrusion member in the paper feed unit according to the first embodiment of the present invention.

As shown in FIGS. 3 and 4, in a lower part of the holding member 40 (portion on a side opposite to the feed roller 31 with respect to the holding member 40), a hollow spring accommodation portion 40*a* is provided which accommodates a first biasing member 42 formed with a compression coil spring. A protrusion member (abutting member) 43 which can be moved along the inner surface of the spring accommodation portion 40*a* and which is protruded from the lower end of the spring accommodation portion 40*a* is coupled to one end portion (lower end portion) 42*a* of the first biasing member 42 on a side opposite to the holding member 40. The tip end portion (lower end portion) of the protrusion member 43 is formed substantially hemispherically. The other end portion (upper end portion) 42*b* of the first biasing member 42 abuts on the lower surface of the holding member 40. The protrusion member 43 is moved in the up/down directions (directions in which the first biasing member 42 is expanded and compressed) along the inner surface of the spring accommodation portion 40*a*, and thus the one end portion 42*a* of the first biasing member 42 is moved in the up/down directions, with the result that the biasing force of the first biasing member 42 is changed. As will be described later, the first biasing member 42 biases the holding member 40 so as to press the retard roller 32 to the feed roller 31.

Figure 5:
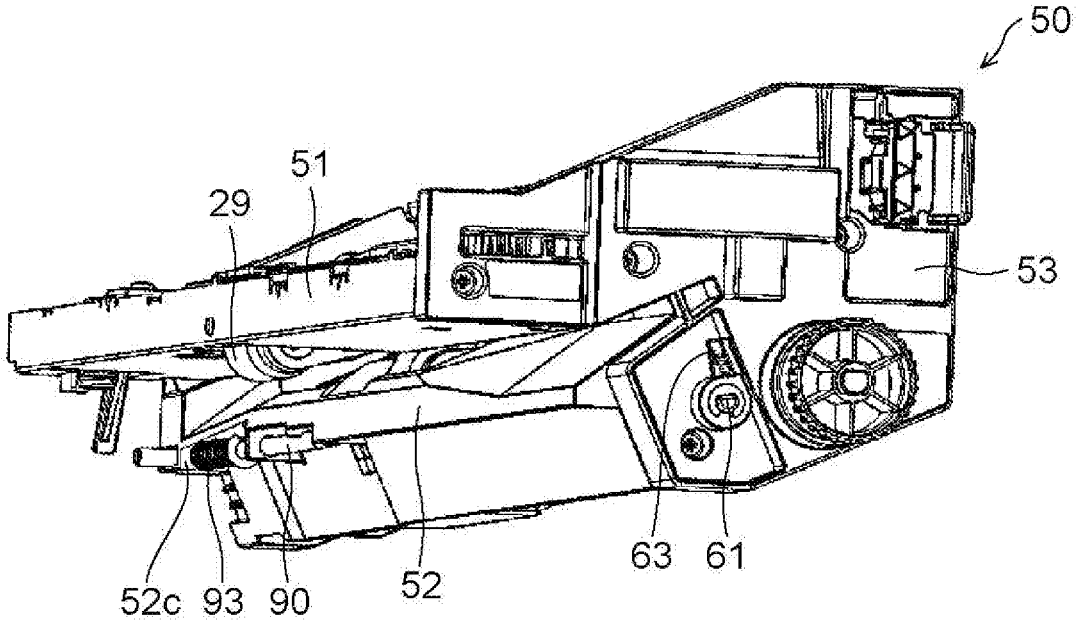
FIG. 5 is a perspective view showing the structures of an upper guide member and a lower guide member which hold the paper feed unit according to the first embodiment of the present invention.

As shown in FIG. 5, the roller holding member 36 (see FIG. 2) is fixed within an upper guide member (frame) 51 which forms the upper surface of the sheet convey path, and the holding member 40 (see FIG. 2) is fixed within a lower guide member (frame) 52 which forms the lower surface of the sheet convey path. The upper guide member 51 and the lower guide member 52 are fixed to a pair of side plate frames (frames) 53.

Here, in the present embodiment, in the lower guide member 52, a pressing force change mechanism 60 (see FIGS. 2 and 3) is provided which changes the pressing force of the retard roller 32 to the feed roller 31. The paper feed unit (sheet feeding device) 50 is formed with the pickup roller 29, the feed roller 31, the retard roller 32, the holding member 40, the first biasing member 42, the pressing force change mechanism 60, the upper guide member 51, the lower guide member 52, the pair of side plate frames 53 and a third biasing member 62, a separation member 90, a second biasing member 93 and the like which will be described later.

As shown in FIG. 3, the pressing force change mechanism 60 includes: a rotation shaft 61 which is arranged parallel to the axial directions (directions of arrows AA') of the retard roller 32; a cam member 70 which is attached to the rotation shaft 61 and which is rotated within a predetermined angle range together with the rotation shaft 61; and a movement member 80 which engages with the cam member 70 and which is moved in the axial directions (directions of the arrows AA') in synchronization with the rotation of the cam member 70 so as to change the biasing force of the first biasing member 42.

Figure 6:
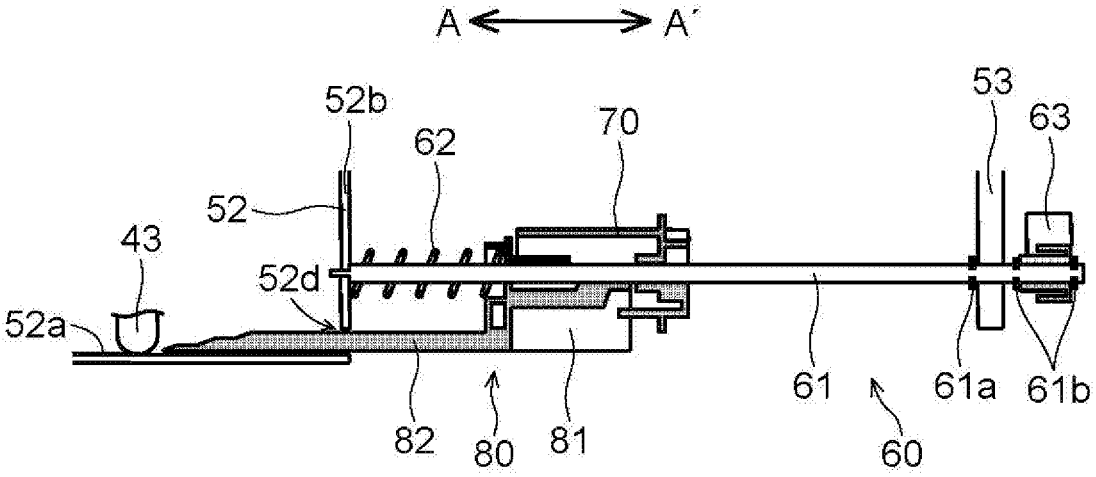
FIG. 6 is a cross-sectional view showing a structure around the pressing force change mechanism in the paper feed unit according to the first embodiment of the present invention.

As shown in FIG. 6, one end portion (right end portion of FIG. 6) of the rotation shaft 61 is pivotally supported with the side plate frame 53, and the other end portion (left end portion of FIG. 6) is pivotally supported with a wall portion 52*b* which is provided within the lower guide member 52. An E ring 61*a* for preventing the rotation shaft 61 from being removed in the direction of the arrow A' and a pair of E rings 61*b* for preventing an operation lever 63 which will be described later from being moved in the axial directions with respect to the rotation shaft 61 are attached to the one end portion of the rotation shaft 61.

Figure 7:
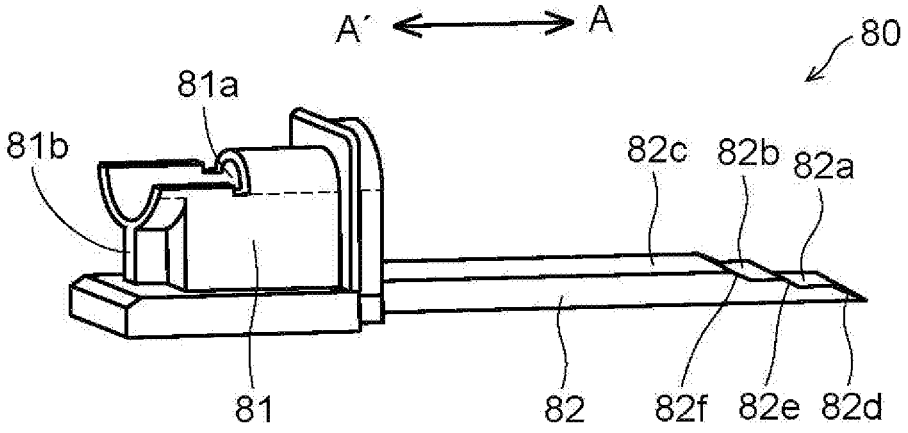
FIG. 7 is a perspective view showing the structure of a movement member in the paper feed unit according to the first embodiment of the present invention.

As shown in FIG. 7, the movement member 80 includes a bearing portion 81 where an insertion hole 81*a* into which the rotation shaft 61 is inserted is formed, and can be moved in the axial directions (directions of the arrows AA') with respect to the rotation shaft 61.

The movement member 80 includes an abutting piece 82 which is extended from the bearing portion 81 in the direction of the arrow A. In the abutting piece 82, a plurality of pressing surfaces 82*a*, 82*b* and 82*c* which abut on the protrusion member 43 (see FIG. 3) are arranged in this order along the axial directions (directions of the arrows AA'). The pressing surfaces 82*a*, 82*b* and 82*c* are formed parallel to the axial directions (directions of the arrows AA') and are provided in the shape of steps such that the positions of the first biasing member 42 in the directions in which the first biasing member 42 is expanded and compressed (the up/down directions in FIGS. 4 and 7) are different from each other. In the direction of the arrow A of the pressing surfaces 82*a*, 82*b* and 82*c*, inclination surfaces 82*d*, 82*e* and 82*f* which are inclined downward toward the direction of the arrow A are respectively provided.

The movement member 80 is moved in the directions of the arrows AA', and thus the protrusion member 43 abuts on, for example, the pressing surface 82*a*, 82*b* or 82*c* such that the amount of protrusion of the protrusion member 43 is changed, with the result that the biasing force of the first biasing member 42 is changed.

As shown in FIG. 6, the abutting piece 82 is inserted into an opening portion 52*d* provided in a lower part of the wall portion 52*b*. The lower surface of the abutting piece 82 is parallel to the inner surface 52*a* of the lower guide member 52, and is slidably supported with the inner surface 52*a* of the lower guide member 52.

In a state (state of FIGS. 6 and 8) where the movement member 80 is arranged most in the direction of the arrow A', the protrusion member 43 does not abut on the movement member 80 and abuts on the inner surface 52*a* of the lower guide member 52. In this state, the first biasing member 42 (see FIG. 4) is the most expanded, and thus the biasing force of the first biasing member 42 is minimized. In this state (state of FIG. 8), the retard roller 32 presses the feed roller 31 with the smallest pressing force.

As shown in FIG. 6, on the side surface of the bearing portion 81 of the movement member 80 in the direction of the arrow A, the third biasing member 62 formed with a compression coil spring is provided. One end portion (end portion in the direction of the arrow A') of the third biasing member 62 abuts on the bearing portion 81, and the other end portion (end portion in the direction of the arrow A) of the third biasing member 62 abuts on the wall portion 52*b* of the lower guide member 52. In this way, the third biasing member 62 biases the movement member 80 in the direction of the arrow A' (one of the axial directions).

Figure 8:
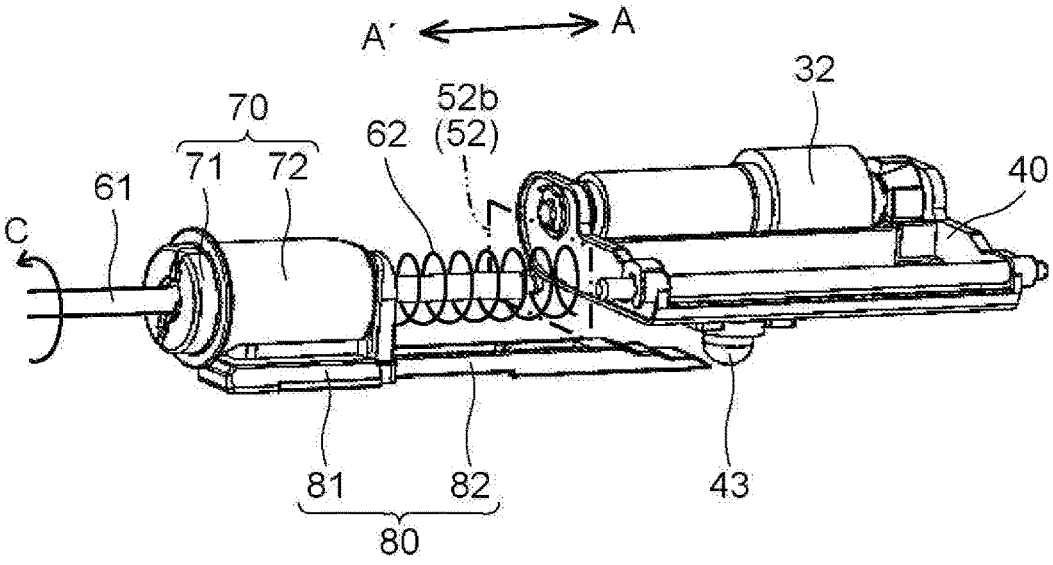
FIG. 8 is a perspective view showing a structure around the retard roller and the pressing force change mechanism in the paper feed unit according to the first embodiment of the present invention and is a diagram showing a state where the protrusion member abuts on the inner surface of the lower guide member.
Figure 9:
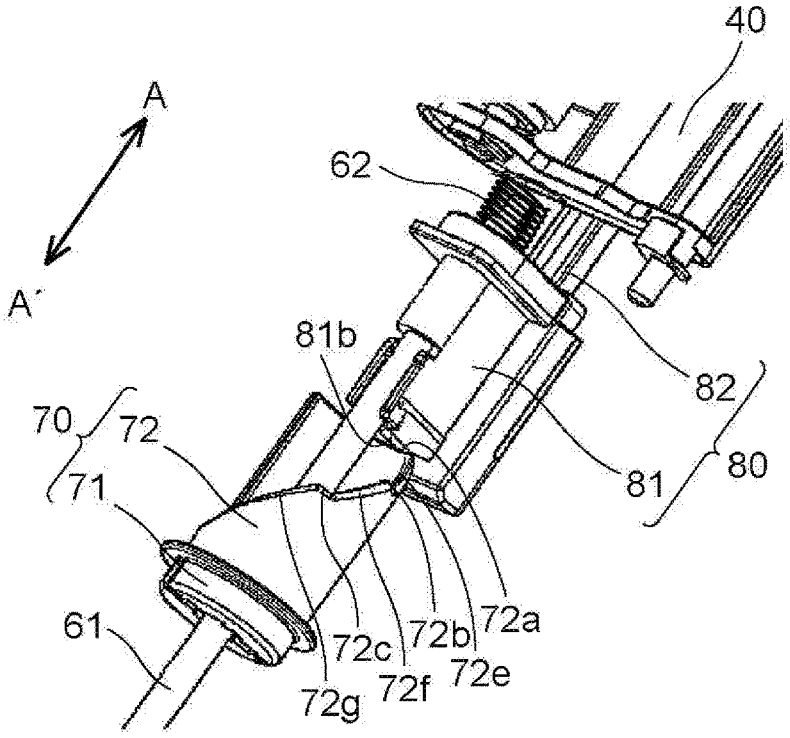
FIG. 9 is a perspective view showing a structure around the movement member and a cam member in the paper feed unit according to the first embodiment of the present invention.
Figure 10:
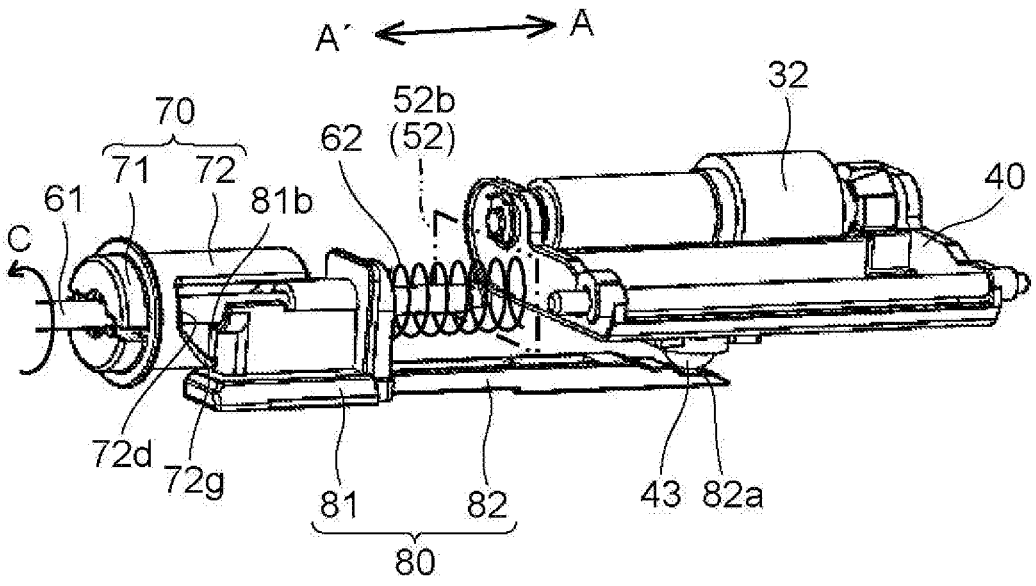
FIG. 10 is a perspective view showing a structure around the retard roller and the pressing force change mechanism in the paper feed unit according to the first embodiment of the present invention and is a diagram showing a state where the protrusion member abuts on the pressing surface 82*a* of the movement member.

As shown in FIGS. 8 and 9, the cam member 70 includes: a flange portion 71 which is fixed to the rotation shaft 61; and a tubular portion 72 which is extended from the flange portion 71 in the direction of the arrow A, in which part is cut out and which is formed substantially in the shape of a cylinder. In the tubular portion 72, as shown in FIGS. 9 and 10, a plurality of engagement surfaces 72*a*, 72*b*, 72*c* an 72*d* which engage with a contact portion 81*b* provided at the end portion of the bearing portion 81 of the movement member 80 in the direction of the arrow A' are arranged in this order along the circumferential direction of the cam member 70. As described above, the cam member 70 is an end surface cam in which a cam surface is formed in the end surface of the tubular portion (cylindrical portion) 72, and in the cam surface, a plurality of engagement surfaces 72*a*, 72*b*, 72*c* an 72*d* perpendicular to the axial directions are formed.

The engagement surfaces 72*a*, 72*b*, 72*c* and 72*d* press the bearing portion 81 in the direction of the arrow A (the other of the axial directions). In a state where the engagement surface 72*a*, 72*b*, 72*c* or 72*d* abuts on the contact portion 81*b* of the bearing portion 81, the movement member 80 is arranged in a predetermined position in the directions of the arrows AA'. The engagement surfaces 72*a*, 72*b*, 72*c* and 72*d* are formed perpendicular to the axial directions (directions of the arrow AA'), and are provided in the shape of steps such that the positions in the axial directions are different from each other.

The engagement surfaces 72*a* and 72*b* are connected together with an inclined surface 72*e*, the engagement surfaces 72*b* and 72*c* are connected together with an inclined surface 72*f* and the engagement surfaces 72*c* and 72*d* are connected together with an inclined surface 72*g*. The cam member 70 is rotated as the rotation shaft 61 is rotated, and thus the position in which the tubular portion 72 abuts on the bearing portion 81 is changed between the engagement surfaces 72*a* to 72*d*.

Specifically, in a state (state of FIG. 8) where the bearing portion 81 abuts on the engagement surface 72*d* (see FIG. 10), the movement member 80 is arranged most in the direction of the arrow A', and thus the abutting piece 82 of the movement member 80 does not abut on the protrusion member 43 of the holding member 40. Here, the protrusion member 43 abuts on the inner surface 52*a* of the lower guide member 52, and thus the biasing force of the first biasing member 42 (see FIG. 4) is minimized, with the result that the pressing force of the retard roller 32 to the feed roller 31 is minimized.

When in the state of FIG. 8, the cam member 70 is rotated in the direction of an arrow C, the bearing portion 81 is moved in the direction of the arrow A while abutting on the inclined surface 72*g* and thereafter abuts on the engagement surface 72*c*. In this state (state of FIG. 10), the pressing surface 82*a* of the abutting piece 82 abuts on the protrusion member 43. Then, the pressing force of the retard roller 32 to the feed roller 31 is increased as compared with the state of FIG. 8.

When in the state of FIG. 10, the cam member 70 is further rotated in the direction of the arrow C, the bearing portion 81 is moved in the direction of the arrow A while abutting on the inclined surface 72*f* and thereafter abuts on the engagement surface 72*b*. In this state (state of FIG. 11), the pressing surface 82*b* of the abutting piece 82 abuts on the protrusion member 43. Then, the pressing force of the retard roller 32 to the feed roller 31 is further increased as compared with the state of FIG. 10.

Figure 11:
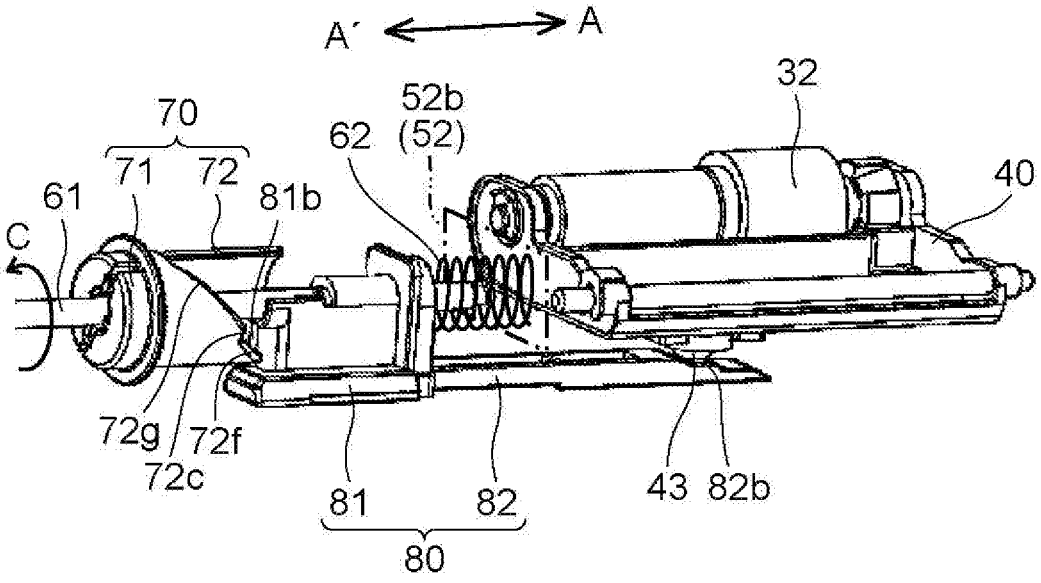
FIG. 11 is a perspective view showing a structure around the retard roller and the pressing force change mechanism in the paper feed unit according to the first embodiment of the present invention and is a diagram showing a state where the protrusion member abuts on the pressing surface 82*b* of the movement member.

When in the state of FIG. 11, the cam member 70 is further rotated in the direction of the arrow C, the bearing portion 81 is moved in the direction of the arrow A while abutting on the inclined surface 72*e* and thereafter abuts on the engagement surface 72*a*. In this state (state of FIG. 12), the pressing surface 82*c* of the abutting piece 82 abuts on the protrusion member 43. Then, the pressing force of the retard roller 32 to the feed roller 31 is maximized.

Here, in the present embodiment, as shown in FIGS. 3 and 5, the one end portion of the rotation shaft 61 (the front surface side end portion of the main body of the image forming apparatus 100, the right end portion of FIG. 3) is protruded outside the side plate frame 53, and the operation lever 63 is fixed to the one end portion of the rotation shaft 61. The operation lever 63 is operated by a user or a maintenance operator, and is arranged in such a position that the operation lever 63 can be operated from the front surface of the main body of the image forming apparatus 100. The operation lever 63 is operated according to the thickness of the sheet 26 by the user or the maintenance operator.

As shown in FIG. 3, in the paper feed unit 50, the separation member 90 is provided that can be moved in directions in which the cassette is inserted and removed (directions of the arrows AA') and that can separate the retard roller 32 from the feed roller 31. The separation member 90 is arranged on the downstream side in the direction in which the cassette is fitted with respect to the holding member 40 (the back side of the main body of the image forming apparatus 100, in the direction of the arrow A), and engages with a corner portion on the back side of the paper feed cassette 10.

Specifically, the separation member 90 is an L-shaped axial member including: a hook portion 91 that is extended in a direction perpendicular to the directions in which the cassette is inserted and removed and that engages with the paper feed cassette 10; and an axial portion 92 that is extended in the directions in which the cassette is inserted and removed.

Around the axial portion 92, the second biasing member 93 formed with a compression coil spring is wound. The end portion (right end portion of FIG. 3) of the second biasing member 93 on the upstream side in the direction in which the cassettes is inserted abuts on a flange portion 92*a* attached to the axial portion 92, and the end portion (end portion in the direction of the arrow A) of the second biasing member 93 on the downstream side in the direction in which the cassettes is inserted abuts on the regulation portion 52*c* (see FIG. 5) of the lower guide member 52. In this way, the second biasing member 93 biases the separation member 90 in the direction of the arrow A' (on the upstream side in the direction in which the cassettes is inserted).

Figure 13:
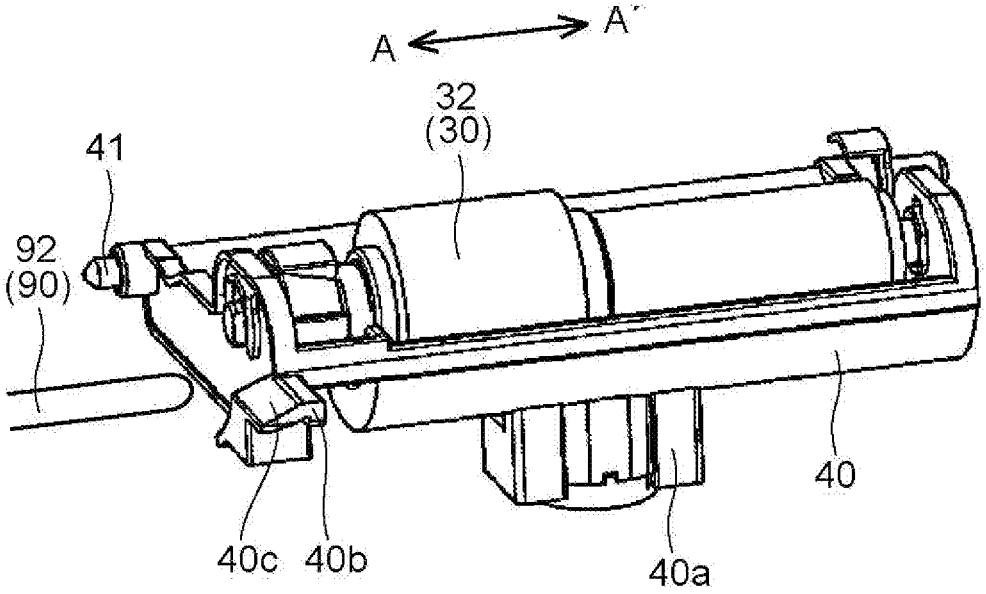
FIG. 13 is a perspective view showing a structure around a holding member in the paper feed unit according to the first embodiment of the present invention.

The holding member 40 includes an abutted portion 40*b* on which the tip end portion of the axial portion 92 of the separation member 90 abuts. In the abutted portion 40*b*, as shown in FIG. 13, an inclination surface 40*c* is formed which is inclined with respect to the directions in which the cassettes is inserted and removed. When the separation member 90 is moved in the direction of the arrow A', the tip end portion of the axial portion 92 abuts on the inclination surface 40*c* so as to press down the holding member 40.

In a state (state of FIG. 3) where the paper feed cassette 10 is fitted to the fitting portion 101, the separation member 90 engages with the paper feed cassette 10 and is arranged in the direction of the arrow A (on the downstream side in the direction in which the cassettes is inserted), and thus the separation member 90 is separated from the holding member 40. In this way, as described above, the retard roller 32 is pressed to the feed roller 31 with a predetermined pressing force according to the biasing force of the first biasing member 42 to the holding member 40.

Figure 14:
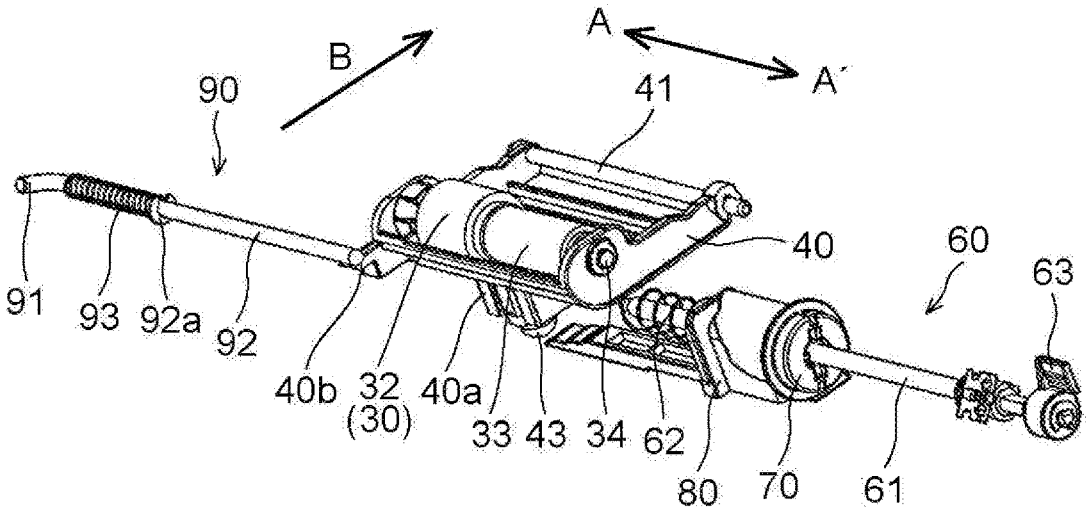
FIG. 14 is a perspective view showing a structure around the retard roller and the pressing force change mechanism in the paper feed unit according to the first embodiment of the present invention and is a diagram showing a state where a separation member presses down the holding member.

On the other hand, in a state (state of FIG. 14) where the paper feed cassette 10 is removed from the fitting portion 101, the separation member 90 is moved in the direction of the arrow A' (on the upstream side in the direction in which the cassette is inserted) by the biasing force of the second biasing member 93. In this way, the tip end portion of the axial portion 92 of the separation member 90 abuts on the holding member 40 so as to press down the holding member 40 in a downward direction, and thus the retard roller 32 is separated from the feed roller 31.

In the present embodiment, as described above, the pressing force change mechanism 60 includes: the rotation shaft 61 which is arranged parallel to the axial directions (directions of the arrows AA') of the retard roller 32; the cam member 70 which is attached to the rotation shaft 61 and which is rotated together with the rotation shaft 61; and the movement member 80 which is brought into contact with the cam member 70 and which is moved in the axial directions (directions of the arrows AA') in synchronization with the rotation of the cam member 70 so as to change the biasing force of the first biasing member 42. In this way, the rotation shaft 61 of the pressing force change mechanism 60 is rotated, and thus the biasing force of the first biasing member 42 is changed, with the result that it is possible to change the pressing force of the retard roller 32 to the feed roller 31. Hence, the pressing force of the retard roller 32 to the feed roller 31 can be changed according to the thickness of the sheet 26, and thus it is possible to reduce the occurrence of a sheet convey failure.

As described above, the movement member 80 is moved in the directions of the arrows AA' so as to be arranged between the one end portion 42*a* of the first biasing member 42 and the inner surface 52*a* of the lower guide member 52, and supports the one end portion 42*a* of the first biasing member 42 such that the one end portion 42*a* is moved in the direction (upward direction) in which the first biasing member 42 is compressed. In this way, the rotation shaft 61 is rotated, and thus it is possible to easily change the biasing force of the first biasing member 42.

As described above, the movement member 80 includes a plurality of pressing surfaces 82 to 82*c* which press the one end portion 42*a* of the first biasing member 42 in the direction (upward direction) in which the first biasing member 42 is compressed, and the pressing surfaces 82*a* to 82*c* are formed in the shape of steps along the directions of the arrows AA' such that the positions in the directions (up/down directions) in which the first biasing member 42 is expanded and compressed are different from each other. In this way, the movement member 80 is moved in the axial directions, and thus it is possible to easily move the one end portion 42*a* of the first biasing member 42 in the directions in which the first biasing member 42 is expanded and compressed.

As described above, in the one end portion 42*a* of the first biasing member 42, the protrusion member 43 is provided which abuts on the movement member 80, and the movement member 80 moves the protrusion member 43 in the directions (up/down directions) in which the first biasing member 42 is expanded and compressed. In this way, since the movement member 80 is prevented from being caught in the one end portion 42*a* of the first biasing member 42, the movement member 80 is moved in the directions of the arrows AA', and thus it is possible to more easily move the one end portion 42*a* of the first biasing member 42 in the directions in which the first biasing member 42 is expanded and compressed.

As described above, when the contact portion 81*b* of the movement member 80 is locked to the predetermined engagement surface 72*a*, 72*b* or 72*c* of the cam member 70, the corresponding pressing surface 82*c*, 82*b* or 82*a* is arranged in such a position that the corresponding pressing surface 82*c*, 82*b* or 82*a* abuts on the protrusion member 43. In this way, it is possible to easily set the biasing force of the first biasing member 42 to a predetermined magnitude.

As described above, the paper feed cassette 10 is fitted to the fitting portion 101, and thus the separation member 90 abuts on the paper feed cassette 10, is moved to the downstream side in the direction in which the cassette is inserted (in the direction of the arrow A) and is separated from the holding member 40, with the result that the retard roller 32 is pressed to the feed roller 31. On the other hand, the paper feed cassette 10 is removed from the fitting portion 101, and thus the separation member 90 is moved to the upstream side in the direction in which the cassette is inserted (in the direction of the arrow A') by the biasing force of the second biasing member 93, and abuts on the holding member 40 so as to separate the retard roller 32 from the feed roller 31. In this way, in a case where a jam (paper jam) occurs in a state where the sheet 26 is nipped between the retard roller 32 and the feed roller 31, when the paper feed cassette 10 is removed from the fitting portion 101 so that jam processing is performed, the nip between the feed roller 31 and the retard roller 32 is released, with the result that it is possible to easily reduce the damage of the sheet 26.

As described above, the separation member 90 is the L-shaped axial member which includes the hook portion 91 and the axial portion 92, and the holding member 40 includes the inclination surface 40*c* on which the tip end portion of the axial portion 92 of the separation member 90 abuts. In this way, the paper feed cassette 10 is fitted to the fitting portion 101, and thus it is possible to easily move the separation member 90 to the downstream side in the direction in which the cassette is inserted (in the direction of the arrow A). The paper feed cassette 10 is removed from the fitting portion 101, and thus the tip end portion of the axial portion 92 abuts on the inclination surface 40*c*, and thus the holding member 40 is moved in a direction (downward direction) away from the feed roller 31, with the result that it is possible to easily separate the retard roller 32 from the feed roller 31.

Second Embodiment

In an image forming apparatus 100 which includes a sheet feeding device according to a second embodiment of the present invention, unlike the first embodiment described above, a pressing force change mechanism 60 is controlled by a control portion (drive control portion) 110 (see FIG. 15) which controls the entire image forming apparatus 100.

Figure 15:
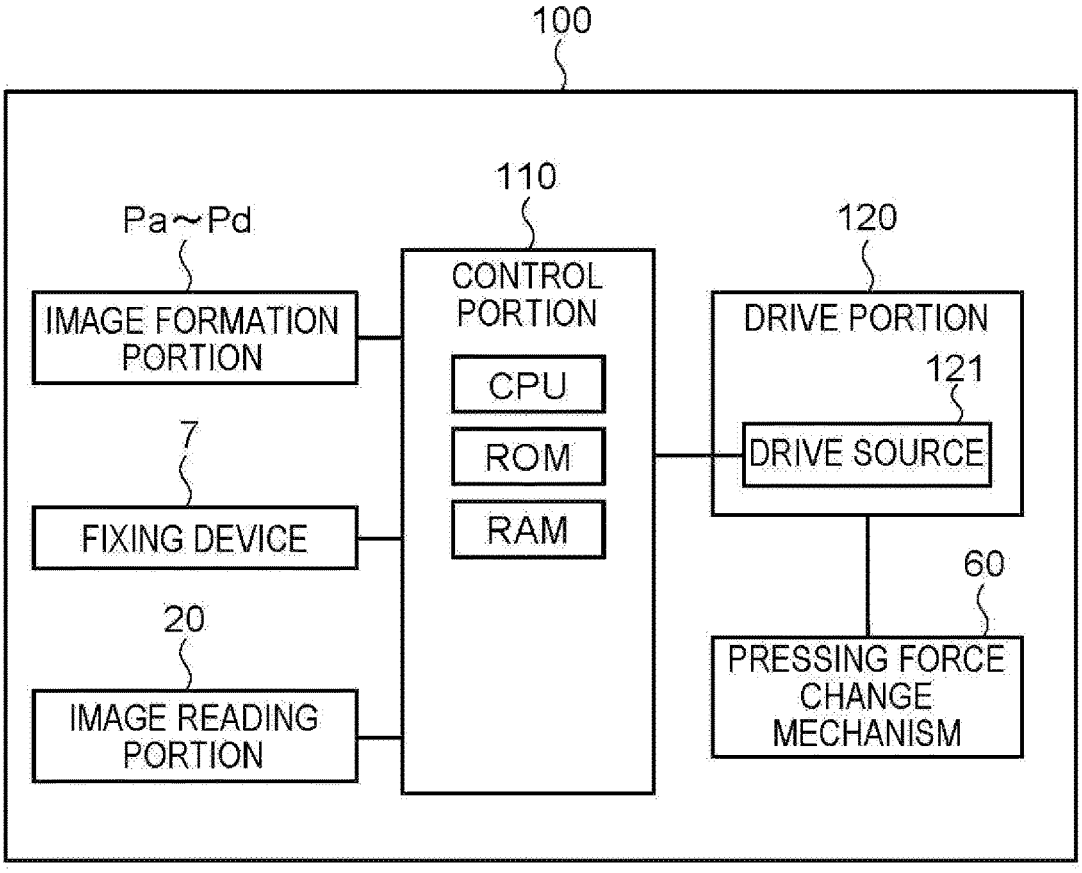
FIG. 15 is a diagram showing a block diagram that shows part of a control path in an image forming apparatus which includes a paper feed unit according to a second embodiment of the present invention.

Specifically, in the present embodiment, the operation lever 63 is not provided on the rotation shaft 61 of the pressing force change mechanism 60, and a drive portion 120 (see FIG. 15) which rotates the rotation shaft 61 is continuously provided. As shown in FIG. 15, the drive portion 120 is formed with: a drive source 121 formed with a stepping motor and the like and power; and a plurality of gears (unillustrated) which transmit a rotary drive force from, the drive source 121 to the rotation shaft 61. The drive source 121 is controlled by a control portion 110.

The control portion 110 is formed with a CPU (Central Processing Unit), a ROM (Read Only Memory), a RAM (Random Access Memory) and the like. The control portion 110 can control the image formation portions Pa to Pd, the fixing device 7, the image reading portion 20, the drive portion 120, various types of rollers and the like.

In the ROM, programs for control of the image forming apparatus 100, numerical values and the like necessary for control, data which is not changed while the image forming apparatus 100 is being used and the like are stored. In the ROM, data in which the types of sheets 26 and the thicknesses of the sheets 26 are associated and data in which the thicknesses of the sheets 26 and the angle position of the cam member 70 are associated are also stored. The type and thickness of sheet 26 may be input to an operation panel (unillustrated) by the user or may be detected with media sensors. In the RAM, necessary data which is produced in the middle of the control of the image forming apparatus 100, data which is temporarily needed for the control of the image forming apparatus 100 and the like are stored.

The control portion 110 rotates the rotation shaft 61 according to the thickness of the sheet 26. Specifically, when the thickness of the sheet 26 is smaller than a first value (for example, in the case of thin paper), the control portion 110 rotates the rotation shaft 61 so as to make the bearing portion 81 abut on the engagement surface 72*d* of the cam member 70. In this way, the state of FIG. 8 is entered, and the pressing force of the retard roller 32 to the feed roller 31 is minimized.

When the thickness of the sheet 26 is equal to or larger than the first value but smaller than a second value, the control portion 110 rotates the rotation shaft 61 only by a predetermined angle so as to make the bearing portion 81 abut on the engagement surface 72*c* of the cam member 70. In this way, the state of FIG. 10 is entered, and the pressing force of the retard roller 32 to the feed roller 31 is higher than that in the state of FIG. 8.

When the thickness of the sheet 26 is equal to or larger than the second value but smaller than a third value, the control portion 110 rotates the rotation shaft 61 only by a predetermined angle so as to make the bearing portion 81 abut on the engagement surface 72*b* of the cam member 70. In this way, the state of FIG. 11 is entered, and the pressing force of the retard roller 32 to the feed roller 31 is much higher than that in the state of FIG. 10.

Figure 12:
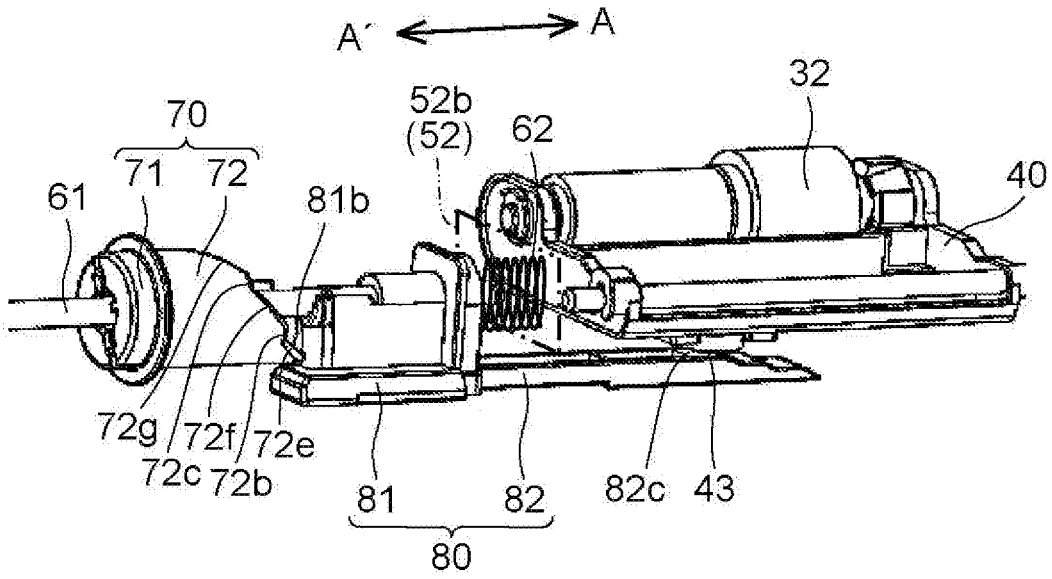
FIG. 12 is a perspective view showing a structure around the retard roller and the pressing force change mechanism in the paper feed unit according to the first embodiment of the present invention and is a diagram showing a state where the protrusion member abuts on the pressing surface 82*c* of the movement member.

When the thickness of the sheet 26 is equal to or larger than the third value (for example, in the case of thick paper), the control portion 110 rotates the rotation shaft 61 only by a predetermined angle so as to make the bearing portion 81 abut on the engagement surface 72*a* of the cam member 70. In this way, the state of FIG. 12 is entered, and the pressing force of the retard roller 32 to the feed roller 31 is maximized.

Although even in the first embodiment described above, the control portion 110 which controls the entire image forming apparatus 100 is provided, in the first embodiment, the control portion 110 does not control the pressing force change mechanism 60.

The other configurations in the second embodiment are the same as in the first embodiment.

In the present embodiment, as described above, the drive portion 120 which rotates the rotation shaft 61 of the pressing force change mechanism 60 and the control portion 110 which controls the drive portion 120 are provided, and the control portion 110 rotates the rotation shaft 61 according to the thickness of the sheet 26. In this way, without bothering the user, it is possible to automatically change the pressing force of the retard roller 32 to the feed roller 31.

The other effects in the second embodiment are the same as in the first embodiment.

It should be considered that the embodiments disclosed here are illustrative in all respects and not restrictive. The scope of the present invention is indicated not by the description of the embodiments discussed above but by the scope of claims, and meanings equivalent to the scope of claims and all modifications within the scope are included.

For example, although the examples are described where the present invention is applied to the tandem type color image forming apparatus as shown in FIG. 1, the present invention is not limited to the examples. Needless to say, the present invention can be applied to various image forming apparatuses, such as a monochrome copying machine, a monochrome printer, a digital multifunctional machine and a facsimile, which include a pickup roller, a feed roller and a retard roller.

Although in the embodiments discussed above, the examples are described where the sheet feeding device of the present invention is used in the image forming apparatus, the sheet feeding device of the present invention may be used in apparatuses other than the image forming apparatus.

Although in the embodiments discussed above, the examples are described where the protrusion member 43 is provided so as to make the pressing surfaces 82*a* to 82*c* of the movement member 80 indirectly (through the protrusion member 43) abut on the one end portion 42*a* of the first biasing member 42, the present invention is not limited to the examples. A configuration may be adopted in which the protrusion member 43 is not provided and in which the pressing surfaces 82*a* to 82*c* of the movement member 80 directly abut on the one end portion of the first biasing member. In this case, the first biasing member may be formed with a biasing member other than a compression coil spring.

The invention claimed is:

1. A sheet feeding device comprising:

a frame;

a feed roller which conveys a sheet fed out from a pickup roller;

a retard roller which forms a feed roller pair together with the feed roller and conveys the sheet while separating sheets;

a holding member which is supported on the frame and holds the retard roller such that the retard roller is capable of being brought into contact with and being separated from the feed roller;

a first biasing member which biases the holding member so as to press the retard roller to the feed roller; and a pressing force change mechanism which changes a pressing force of the retard roller to the feed roller, wherein the pressing force change mechanism includes:

a rotation shaft which is arranged parallel to an axial direction of the retard roller;

a cam member which is attached to the rotation shaft and which is rotated together with the rotation shaft; and a movement member which is brought into contact with the cam member and moved in the axial direction in conjunction with the rotation of the cam member so as to change a biasing force of the first biasing member, the first biasing member includes a compression coil spring of which one end portion is supported on the frame and of which the other end portion is arranged so as to be in contact with the holding member, the movement member moved in the axial direction so as to be located between the one end portion of the first biasing member and the frame, and supports the one end portion such that the one end portion is moved in a compression direction in which the compression coil spring is compressed, the movement member includes a plurality of pressing surfaces which press the one end portion of the first biasing member in the compression direction, and the pressing surfaces are arranged in a shape of steps along the axial direction such that positions in the directions in which the compression coil spring is expanded and compressed are different from each other, in the one end portion of the first biasing member, an abutting member is provided which abuts on one of the pressing surfaces of the movement member, and the pressing surfaces of the movement member move the abutting member in the directions in which the compression coil spring is expanded and compressed.

2. The sheet feeding device according to claim 1, wherein the cam member is an end surface cam in which a cam surface is formed on an end surface of a cylindrical portion, and on the cam surface, a plurality of engagement surfaces perpendicular to the axial direction are formed, the movement member includes a contact portion which is brought into contact with the cam surface and when the contact portion is locked to one of the engagement surfaces of the cam surface, a corresponding pressing surface of the pressing surfaces is arranged in such a position as to abut on the abutting member.

3. An image forming apparatus comprising:

a fitting portion;

a sheet storage cassette which is inserted into and removed from the fitting portion;

the sheet feeding device according to claim 1 which is arranged in the fitting portion; and an image formation portion which forms an image on the sheet.

4. The image forming apparatus according to claim 3, wherein the fitting portion includes:

a separation member that is provided so as to be able to move in directions in which the sheet storage cassette is inserted and removed and that separates the retard roller from the feed roller while the sheet storage cassette is removed; and a second biasing member that biases the separation member to an upstream side in an insertion direction in which the cassette is inserted, the sheet storage cassette is fitted to the fitting portion such that the separation member abuts on the sheet storage cassette, is moved to a downstream side in the insertion direction and is separated from the holding member so as to press the retard roller to the feed roller and the sheet storage cassette is removed from the fitting portion such that the separation member is moved to the upstream side in the insertion direction by a biasing force of the second biasing member and abuts on the holding member so as to separate the retard roper from the feed roller.

5. The image forming apparatus according to claim 4, wherein the separation member is an axial member including: a hook portion that is extended in a direction perpendicular to the directions in which the sheet storage cassette is inserted and removed and that engages with the sheet storage cassette; and an axial portion that is extended in the directions in which the sheet storage cassette is inserted and removed and that abuts on the holding member, the holding member includes an inclination surface on which a tip end potion of the axial portion of the separation member abuts and which is inclined downward toward the tip end portion and the tip end portion of the axial portion abuts on the inclination surface such that the holding member is moved in a direction away from the feed roller so as to separate the retard roller from the feed roller.

6. The image forming apparatus according to claim 3, further comprising:

a drive portion which rotates the rotation shaft of the pressing force change mechanism; and a drive control portion which controls the drive portion, wherein the drive control portion rotates the rotation shaft according to a thickness of the sheet.

7. An image forming apparatus comprising:

a fitting portion;

a sheet storage cassette which is inserted into and removed from the fitting portion;

a sheet feeding device arranged in the fitting portion; and an image formation portion which forms an image on a sheet, wherein the sheet feeding device includes:

a frame;

a feed roller which conveys the sheet fed out from a pickup roller;

a retard roller which forms a feed roller pair together with the feed roper and conveys the sheet while separating sheets;

a holding member which is supported on the frame and holds the retard roller such that the retard roller is capable of being brought into contact with and being separated from the feed roller;

a first biasing member which biases the holding member so as to press the retard roller to the feed roller; and a pressing force change mechanism which changes a pressing force of the retard roller to the feed roller, wherein the pressing force change mechanism includes:

a rotation shaft which is arranged parallel to an axial direction of the retard roller;

a cam member which is attached to the rotation shaft and which is rotated together with the rotation shaft; and a movement member which is brought into contact with the cam member and moved in the axial direction in conjunction with the rotation of the cam member so as to change a biasing force of the first biasing member, wherein the fitting portion includes:

a separation member that is provided so as to be able to move in directions in which the sheet storage cassette is inserted and removed and that separates the retard roller from the feed roller while the sheet storage cassette is removed; and a second biasing member that biases the separation member to an upstream side in an insertion direction in which the cassette is inserted, the sheet storage cassette is fitted to the fitting portion such that the separation member abuts on the sheet storage cassette, is moved to a downstream side in the insertion direction and is separated from the holding member so as to press the retard roller to the feed roller, and the sheet storage cassette is removed from the fitting portion such that the separation member is moved to the upstream side in the insertion direction by a biasing force of the second biasing member and abuts on the holding member so as to separate the retard roller from the feed roller.

8. An image forming apparatus comprising:

a fitting portion;

a sheet storage cassette which is inserted into and removed from the fitting portion;

a sheet feeding device arranged in the fitting portion;

an image formation portion which forms an image on a sheet;

a drive portion; and a drive control portion, wherein the sheet feeding device includes:

a frame;

a feed roller which conveys the sheet fed out from a pickup roller;

a retard roller which forms a feed roller pair together with the feed roller and conveys the sheet while separating sheets;

a holding member which is supported on the frame and holds the retard roller such that the retard roller is capable of being brought into contact with and being separated from the feed roller;

a first biasing member which biases the holding member so as to press the retard roller to the feed roller; and a pressing force change mechanism which changes a pressing force of the retard roller to the feed roller, wherein the pressing force change mechanism includes:

a rotation shaft which is arranged parallel to an axial direction of the retard roller, a cam member which is attached to the rotation shaft and which is rotated together with the rotation shaft; and a movement member which is brought into contact with the cam member and moved in the axial direction in conjunction with the rotation of the cam member so as to change a biasing force of the first biasing member, the drive portion rotates the rotation shaft of the pressing force change mechanism, and the drive control portion controls the drive portion and rotates the rotation shaft according to a thickness of the sheet.

* * * * *